United States Patent [19]

Volsky

[11] 4,161,936

[45] Jul. 24, 1979

[54] AUDIO FREQUENCY IONIZATION IGNITION SYSTEM

[76] Inventor: Bill V. Volsky, 430-11th Ave., SE., Calgary, Alberta, Canada

[21] Appl. No.: 788,829

[22] Filed: Apr. 19, 1977

Related U.S. Application Data

[63] Continuation-in-part of Ser. No. 424,235, Jan. 24, 1974, abandoned.

[51] Int. Cl.[2] ..... F02P 1/00

[52] U.S. Cl. ..... 123/148 E; 315/209 T

[58] Field of Search ..... 123/148 E, 148 AC, 148 R, 123/148 CB; 315/209 T

[56] References Cited

U.S. PATENT DOCUMENTS

| | | | |
|---|---|---|---|
| 3,818,885 | 6/1974 | Canup | 123/148 E |
| 3,897,767 | 8/1975 | Gordon et al. | 123/148 E |
| 4,051,828 | 10/1977 | Topic | 123/148 E |

*Primary Examiner*—Charles J. Myhre
*Assistant Examiner*—Tony M. Argenbright
*Attorney, Agent, or Firm*—Stanley G. Ade

[57] ABSTRACT

This invention relates to an ignition system which produces a continuous sinusoidal wave at audio frequency in order to produce a continuous spark discharge during certain times, at the spark plugs and is usable in any form of gasoline burning internal combustion engine using an ignition system. It can be fitted to any type or size of automobile or industrial engines and includes a power transistor oscillator circuit with a solid state high voltage generator switched with a switching transistor and actuated by the make and break circuit operated by the breaker points but independently of ignition timing. The spark discharge causes ionization between the spark plug points and produces ozone thereby improving the quality and speed of burning and, because of the more efficient operation, decreases noxious emissions from the exhaust system.

3 Claims, 1 Drawing Figure

AUDIO FREQUENCY IONIZATION IGNITION SYSTEM

BACKGROUND OF THE INVENTION

This is a Continuation-in-Part application of Ser. No. 424,235, filed Jan. 24, 1974 now abandoned.

In conventional ignition systems, a one pulse spark is utilized caused by the interruption of the primary circuit leading to the collapse of the electromagnetic field through the secondary coil. Because the effectiveness of single sparks is limited, the present invention was designed which gives, during certain periods, a continuous discharge across the spark plug points.

It is well known that by increasing the voltage of the secondary circuit of conventional ignition systems, it is only possible to obtain relatively small improvements as even the so called "capacitive discharge systems" only small improvements are obtained. With conventional ignition systems, the percentage of usable energy from the fuel is not increased.

In fact the only way to increase the energy and quality of ignition is to use alternating current spark discharges of long duration.

The prior art describes and illustrates various types of high frequency continuous wave high voltage ignition systems but these particular systems are not successful for various reasons. Experiments have shown that the wave form and the frequency and voltage levels are the three important coefficients and the proper choice and tuning of these three coefficients will improve the combustion process considerably.

I have found that a sinusoidal wave form is more effective than the conventional square wave form particularly if the frequency range is within the audio range and the voltage is not increased but descreased and the present invention provides circulitry which allows the proper tuning of these three coefficients.

SUMMARY OF THE INVENTION

The present invention therefore deals with an audio frequency sinusoidal wave continuous high voltage ignition system for internal gasoline burning combustion engines.

The system includes a solid state power generator for generating a high voltage audio frequency current for the distributor together with an oscillator for supplying a continuous sinusoidal wave form long duration spark discharge, together with a switching circuit for controlling the energization of the oscillator.

The principal object and essence of the invention is therefore to provide an ignition system which gives a continuous high voltage audio frequency current for use by the distributor having a sinusoidal wave form, generated from low voltage D.C. current and utilizing solid state circuitry.

Another object of the invention is to provide a device of the character herewithin described which includes a solid state high voltage power generator producing an audio frequency high voltage ignition current and utilizing the conventional distributor to give a continuous high voltage spark discharge to each cylinder during the time that the contact breaker points are in the open position.

Yet another object of the invention is to provide a device of the character herewithin described in which the spark discharge between the plug contacts causes ionization and the formation of a significant amount of ozone thus assisting in the proper and more efficient burning of the gas/air mixture within the cylinders.

A still further object of the invention in conjunction with the foregoing object is to produce ozone at the time of ignition which supports the burning of the compressed fuel/air mixture and increases the rate of flame propagation.

Yet another object of the invention is to provide a device of the character herewithin described in which the efficiency of the burning fuel is increased and the emission of noxious gases is reduced.

Still another object of the invention is to provide a device of the character herewithin described which is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DETAILED DESCRIPTION

Figure 1:
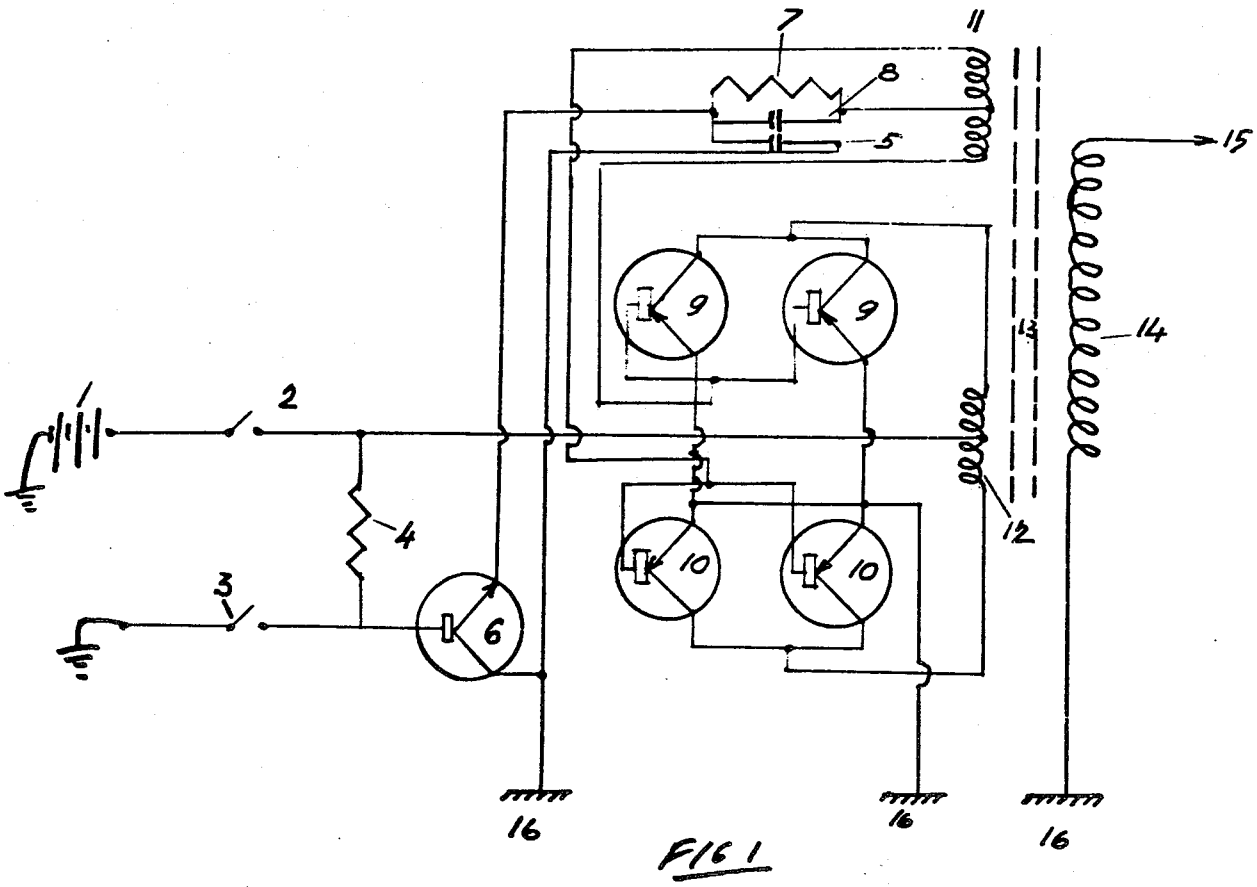
FIG. 1 is a schematic wiring diagram of the device.

Proceeding therefore to describe the invention in detail, reference should be made to the accompanying drawing in which a solid state generator is shown including a secondary high voltage coil 14, a ferrite core 13, and a primary comprising two center tapped coils namely the triggering coil 11 and the power coil 12.

An oscillator circuit is provided which includes two pairs of joint transistors 9 and 10 in push/pull relationship and with the transistors of each pair being connected in parallel.

The bases of one pair of transistors 9 are connected to one side of the triggering coil 11 of the primary and the bases of the other pair of transistors 10 are connected to the other side of the triggering coil 11.

The collectors of the transistors 9 are connected to one side of the power coil 12 and the collectors of the transistors 10 are connected to the other side of the coil 12 as clearly illustrated.

A center tap is taken from the power coil 12 and is connected permanently to the low voltage D.C. current from the battery via the ignition switch 2, reference character 1 illustrating schematically, a conventional storage battery.

The center tap of the triggering coil 11 is connected to the junction of a resistor 7 and a relatively large capacitor 8. The emitters of all of the power transistors 9 and 10 are grounded as illustrated by reference character 16.

The foregoing produces a relatively simple push/pull system which, when operating, produces a train of sinusoidal wave form pulses.

A switching circuit is provided which includes a single switching transistor 6 with the base thereof connected to one side of the breaker points 3 (shown schematically), the other side of the breaker points being connected to ground 16. The base current from the switching transistor 6 extends through a resistor 4 connected across the lines extending from the positive side of the battery and from the line extending from the breaker points 3.

The emitter of this switching transistor 6 is connected to the junction between the other sides of the aforementioned resistor 7 and relatively large capacitor 8 and to one side of a smaller capacitor 5.

The other side of this relatively small capacitor 5 extends to the collector of the switching transistor 6 and thence to ground 16 as clearly shown.

From the foregoing it will be appreciated that the system consists of three main elements or components operating together, said elements including the solid state power generator 14, the oscillator circuits 9 and 10 and the switching circuit provided by transistor 6 in combination with the resistor 7 and the capacitors 5 and 8.

It will be appreciated that both coils 11 and 12 of the primary of the power generator 14 are center tapped with an equal number of coil turns on the left and right sides of the center tap and that both coils are wound beside one another on a proper insulating tube in the conventional manner.

Because the frequency level is determined by the coefficients of the number of turns of the primary coils 11 and 12 and by the section and characteristics of the ferrite core, the selection of these parameters will determine the operating characteristics of this system.

As an example, with the secondary producing spark discharge in the frequency of between 9 and 15 KH, the triggering coil is provided with between 10 and 15 left and right hand turns using an enameled copper wire having a 25 gauge. The power coil 12 in this example has between 3 to 5 left and right hand turns wound from gauge 11 copper wire.

The design parameters of the ferrite core 13 are also important and I have found that the best results are obtained with ferrites having a high saturation flux density of approximately 4400 gauss and a low coil loss of approximately 110 mV/cm3. In this example, the specific frequency of the core is 16 KHz, the system described produces a high voltage audio frequency ignition current continuously while the breaker points are open, having a level of between 10 to 16 kilovolts and preferably in the range of 15 kilovolts. The voltage, is generated from the standard storage battery 1 transferred into a low voltage A.C. current by the oscillator circuit.

In the present example, the high voltage coil or secondary coil 14 is wound from gauge 26 copper wire with approximately 6500 turns thereby giving a resistance no greater than 155 ohms. The coil is internally filled with an insulating material under vacuum thereby avoiding micro vibration of the coils and one side of this coil is grounded as at 16 with the other end delivering the high voltage audio frequency ignition current via a shielded ignition cable (not illustrated) to the center of the distributor cap (not illustrated) in the normal manner.

The oscillator circuit employs the four power transistors 9 and 10 connected in push/pull relationship and preferably utilizing germanium PNP power transistors which are more economical than silicon transistors.

These transistors should preferably have a 150 watt power output and by using the correct value resistors and capacitors in the base circuits of the complex of the oscillator, they may be kept within the temperature limits required particularly when installed on properly dimensioned heat sinks (not illustrated) as is conventional. One of the difficulties in the prior art is to solve the synchronization problem with only one capacitor. This is undertaken in the present device by supplying the D.C. source from the storage battery connected through the car ignition switch 2, permanently to the solid state power generator primary power coil 12 center tap. The collector electrodes of the two pairs of transistors 9 and 10 are connected to the opposite ends of this power coil 12, the electrodes of the transistors 9 being attached to one side and the electrodes of the transistors 10 being connected to the other side. The emitters of these transistors are connected to the ground 16 as clearly shown. The base electrodes of these transistors 9 and 10 are connected respectively to the opposite ends of the primary triggering coil 11, the electrodes of transistors 9 being connected to one side and the electrodes of transistors 10 being connected to the other side.

The aforementioned synchronization of oscillation, regulation of base current flow and the absorbing of surge energy are realized by the provision of the capacitors 5 and 8 and the resistor 7 with the values chosen to suit the particular design parameters. As mentioned previously, the resistor 7 and the relatively large capacitor 8 are connected in parallel with one end being connected to the center tap of the triggering coil 11 of the primary and the other end being connected in a common junction with the smaller capacitor 5 to the emitter of the switching transistor 6. The other end of the smaller capacitor 5 is connected to the collector electrode of the switching transistor 6 and to ground and is utilized to limit switching spikes and to reduce feedback to the battery and it should also be observed that the present device utilizes an extremely simple embodiment of the oscillator switching circuitry whereas prior art references normally utilize a complicated system or circuit for this purpose with control coils and diodes in combination. In the present device, a simple switching transistor is utilized without the necessity of using control coils, diodes and the like. In the present device, and by way of example only, an NPN transistor is utilized with a 150 watt output. 0.5 miliamp base current is utilized and is supplied from the battery through the resistor 4. This is connected to the base of the transistor 6 and is also connected to the breaker point terminal 3 as illustrated. This very low current is passed through the breaker point contacts so that the breaker point contacts do not oxidize or burn and only need adjustment after long intervals of use.

When the breaker point contacts are open, the switching transistor closes the oscillator circuit and the oscillator circuit produces the audio frequency signals to the power generator. When the breaker point contacts are closed (dwell), the switching transistor disconnects the oscillator circuit and the oscillator ceases to operate thereby preventing any current drain from the battery. The duration of sparking discharge is provided with the breaker point contact screw which controls the dwell.

When the distributor rotor is moved in synchronization with the engine, the segment of the rotor opens the breaker point contacts 3 thus disconnecting same from ground 16 so that the switching transistor connects the oscillator and starts producing audio frequency signals to the primary of the high voltage generator 14 through the combined embodiment of the capacitor 8 and resistor 7. This reduces the base current for the power transistor base circuit and synchronizes the output. The high voltage generator produces high voltage audio frequency ignition current according to the oscillating signals from the oscillator.

The output from the secondary 14 is delivered by shielded high voltage copper wire to the distributor cap center which distributes the output in sequence of firing order of the engine to the required cylinder. The final effect of this audio frequency ionization ignition system produces a sinusoidal wave form audio frequency high voltage high energy ignition current to the spark plug points of relatively long duration high energy sparking thus causing an ionization field and producing significant amounts of ozone.

In this regard it has been found that the most efficient spark discharge will be produced if the spark plug gap is approximately 2 mm, the ionization field and the ozone improve the combustion of the air/fuel mixture and enables this air/fuel mixture to be changed to approximately 1:16.8 instead of the usual 1:13 ratio normally used. It is believed that the conventional molecular chain reaction combustion is changed by this type of ignition to a more turbulent type of combustion similar to the diesel ignition.

Because of the foregoing, emissions of carbon monoxide and unburned hydrocarbons are significantly lower than conventional. Nitrous oxide discharges are lowered particularly if the timing is advanced by approximately 6 to 9 degrees and it has been found that this timing advance does not effect engine operating temperatures.

Tuning is best carried out by a gas analyzer as follows. After warming up the engine and calibrating the analyzer, the flexible pipe of the analyzer is connected to the exhaust tail pipe of the engine. The carburator is choked by the idling screws and at the same time the distributor should be advanced. Tuning of the idling screws is continued until the engine runs smoothly and the analyzer reading will show a carbon monoxide value of approximately 0.12 to 0.13 and hydrocarbon emissions will show between 200 to 250 ppm. The ignition is then tightened and the engine is tuned.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. An ignition device for ignition systems of automobiles and the like which includes a source of low voltage D.C. electrical energy and a mechanically operated contact breaker assembly; comprising in combination a solid state high voltage generator, a sinusoidal wave push/pull oscillator circuit operatively connected to said generator and to said source of electrical energy, and a switching circuit operatively connected to said oscillator circuit for controlling the energization of said oscillator circuit, said generator including a high frequency secondary coil operatively connected to the associated ignition system, a triggering primary coil and a power primary coil, said power coil being operatively connected to said oscillator circuit and to the associated source of electrical energy, said switching circuit including said triggering primary coil and a single switching transistor operatively connected between said triggering primary coil, said source of electrical energy and said associated contact breaker assembly whereby the opening and closing of said contact breaker assembly activates said switching circuit and hence synchronizes the output of said power generator with the ignition system, said switching circuit including means to absorb surge energy in said oscillator circuit, said means including a resistor and capacitor in parallel with one another, one side of said resistor and capacitor being connected centrally to said triggering coil, the other side of said resistor and capacitor being connected to the emitter of said switching transistor, and a further capacitor being connected between said other side of said first mentioned resistor and capacitor and the collector of said switching transistor.

2. The device according to claim 1 in which said oscillator circuit includes at least two pairs of transistors in push/pull relationship, the bases of one pair of said transistors being connected to one side of said triggering coil and the bases of the other pair of said transistors being connected to the other side of said triggering coil, the collectors of said one pair of transistors being connected to one side of said power coil, the collectors of the other pair of said transistors being connected to the other side of said power coil, said source of electrical energy being connected to the center of said power coil.

3. An ignition system for an internal combustion engine for improving the efficiency and reducing noxious emissions thereof by causing turbulent combustion by means of an electrical ignition impulse across a spark gap, said electrical ignition impulse having a sinusoidal waveform and a frequency of about 10,000 to 15,000 Hertz, said ignition system comprising:

(a) a transformer having a power secondary coil connected to said spark gap, a power primary coil, and a feedback primary coil, said primary coils each having center taps, (b) a transistor power amplifier connecting said power primary coil and said feedback coil, (c) a switching transistor connected to said center tap of said feedback primary coil, (d) a DC bias voltage connected to said center of said power primary coil, and (e) breaker points connecting said switching transistor to ground.

* * * * *